US006225276B1

(12) United States Patent
Gassenmeier et al.

(10) Patent No.: US 6,225,276 B1
(45) Date of Patent: May 1, 2001

(54) PH-CONTROLLED RELEASE OF DETERGENT COMPONENTS

(75) Inventors: Thomas Gassenmeier; Juergen Millhoff, both of Duesseldorf; Thomas Mueller-Kirschbaum, Solingen, all of (DE)

(73) Assignee: Henkel Kommanditgesellschaft auf Aktien, Duesseldorf (DE)

( * ) Notice: Subject to any disclaimer, the term of this patent is extended or adjusted under 35 U.S.C. 154(b) by 0 days.

(21) Appl. No.: 09/367,091

(22) PCT Filed: Jan. 29, 1998

(86) PCT No.: PCT/EP98/00474

§ 371 Date: Aug. 6, 1999

§ 102(e) Date: Aug. 6, 1999

(87) PCT Pub. No.: WO98/35009

PCT Pub. Date: Aug. 13, 1998

(30) Foreign Application Priority Data

Feb. 7, 1997 (DE) ..... 197 04 634

(51) Int. Cl.[7] ..... C11D 3/395
(52) U.S. Cl. ..... 510/376; 510/438
(58) Field of Search ..... 510/438, 444, 510/443, 376

(56) References Cited

U.S. PATENT DOCUMENTS

| | | | | |
|---|---|---|---|---|
| 2,992,186 | | 7/1961 | Hellsten | 252/135 |
| 3,847,830 | * | 11/1974 | Williams et al. | 252/186 |
| 3,992,317 | | 11/1976 | Brichard et al. | 252/186 |
| 4,120,812 | | 10/1978 | Lutz | 252/186 |
| 4,131,562 | | 12/1978 | Lutz | 252/186 |
| 4,131,879 | | 12/1978 | Ehrat | 340/146.3 |
| 4,135,010 | | 1/1979 | Klebe et al. | 427/215 |
| 4,194,025 | | 3/1980 | Klebe et al. | 427/215 |
| 4,303,542 | | 12/1981 | Heinlein et al. | 252/91 |
| 4,321,301 | | 3/1982 | Brichard et al. | 428/403 |
| 4,428,914 | | 1/1984 | Brichard et al. | 423/265 |
| 4,524,009 | | 6/1985 | Valenty et al. | 252/89.1 |
| 4,526,698 | | 7/1985 | Kuroda et al. | 252/99 |
| 4,639,325 | | 1/1987 | Valenty et al. | 252/89.1 |
| 4,664,839 | | 5/1987 | Rieck | 252/175 |
| 4,820,439 | | 4/1989 | Rieck | 252/135 |
| 4,849,198 | | 7/1989 | Ruhs | 423/415 P |
| 4,985,553 | | 1/1991 | Fuertes et al. | 536/124 |
| 5,000,869 | | 3/1991 | Ditter | 252/174.13 |
| 5,188,774 | | 2/1993 | Nitta et al. | 264/22 |
| 5,423,997 | * | 6/1995 | Ahmed et al. | 252/99 |
| 5,458,801 | * | 10/1995 | Oyashiki et al. | 252/186.25 |
| 5,501,814 | | 3/1996 | Engelskirchen et al. | 252/174.17 |
| 5,780,420 | | 7/1998 | Breuer et al. | 510/466 |
| 5,821,360 | | 10/1998 | Engelskirchen et al. | 536/124 |

FOREIGN PATENT DOCUMENTS

| | | | |
|---|---|---|---|
| 857 017 | | 1/1978 | (BE) . |
| 1 000 628 | | 11/1976 | (CA) . |
| 23 37 338 | | 2/1974 | (DE) . |
| 24 02 392 | | 8/1974 | (DE) . |
| 24 02 393 | | 8/1974 | (DE) . |
| 24 17 572 | | 11/1974 | (DE) . |
| 26 22 610 | | 9/1976 | (DE) . |
| 28 00 916 | | 7/1978 | (DE) . |
| 27 12 138 | | 9/1978 | (DE) . |
| 28 10 379 | | 9/1979 | (DE) . |
| 29 16 416 | | 11/1980 | (DE) . |
| 33 21 082 | | 12/1983 | (DE) . |
| 44 00 024 | | 7/1995 | (DE) . |
| 44 43 177 | | 6/1996 | (DE) . |
| 024 201 | | 2/1981 | (EP) . |
| 0 030 759 | | 6/1981 | (EP) . |
| 0 150 930 | | 8/1985 | (EP) . |
| 0 164 154 | | 12/1985 | (EP) . |
| 0 232 202 | | 8/1987 | (EP) . |
| 0 290 081 | | 11/1988 | (EP) . |
| 0 295 384 | | 12/1988 | (EP) . |
| 0 396 287 | | 11/1990 | (EP) . |
| 0 427 349 | | 5/1991 | (EP) . |
| 0 472 042 | | 2/1992 | (EP) . |
| 0 525 239 | | 2/1993 | (EP) . |
| 0 542 496 | | 5/1993 | (EP) . |
| 0 651 053 | | 5/1995 | (EP) . |
| 2 180 864 | | 11/1973 | (FR) . |
| 1 398 876 | | 6/1973 | (GB) . |
| 1 538 893 | | 1/1979 | (GB) . |
| 94 19 091 | | 3/1996 | (GB) . |
| 58 217598 | | 12/1983 | (JP) . |
| 93 339896 | | 12/1993 | (JP) . |
| WO90/13533 | | 11/1990 | (WO) . |
| WO 95/14077 | * | 5/1991 | (WO) . |
| WO90/08171 | | 6/1991 | (WO) . |
| WO92/18542 | | 10/1992 | (WO) . |
| WO93/08251 | | 4/1993 | (WO) . |
| WO 94/15010 | * | 7/1994 | (WO) . |
| WO94/27970 | | 12/1994 | (WO) . |
| WO94/28030 | | 12/1994 | (WO) . |
| WO94/28102 | | 12/1994 | (WO) . |

(List continued on next page.)

*Primary Examiner*—John Hardee
(74) *Attorney, Agent, or Firm*—Wayne C. Jaeschke; Glenn E. J. Murphy

(57) ABSTRACT

A process for washing textiles is presented involving the delayed release of ingredients from a detergent composition. The process involves first dissolving the detergent in water resulting in a pH below pH 8, slowly dissolving the coating on a coated alkalizing agent to raise the pH to above pH to above pH 8.5, and above pH 8.5 the polymeric acid coating on a detergent ingredient dissolves, releasing the ingredient into the wash water. Also presented is a detergent composition for delayed bleaching of 1 to 40 percent by weight of a coated bleaching agent having a coating which dissolves slowly in water irrespective of the pH value, 0.5 to 15 percent by weight of a bleach activator coated with a polymeric acid, and 0.1 to 40 percent by weight of an acidifying agent. The process results in a delayed release of bleaching in the wash cycle.

13 Claims, No Drawings

FOREIGN PATENT DOCUMENTS

| | | |
|---|---|---|
| WO94/28103 | 12/1994 | (WO) . |
| WO95/00626 | 1/1995 | (WO) . |
| WO90/107331 | 3/1995 | (WO) . |
| WO9507303 | 3/1995 | (WO) . |
| WO95/12619 | 5/1995 | (WO) . |
| WO95/14075 | 5/1995 | (WO) . |
| WO95/14759 | 6/1995 | (WO) . |
| WO95/17498 | 6/1995 | (WO) . |
| WO95/20029 | 7/1995 | (WO) . |
| WO95/20608 | 8/1995 | (WO) . |
| WO95/28454 | 10/1995 | (WO) . |
| WO95/28464 | 10/1995 | (WO) . |
| WO95/28465 | 10/1995 | (WO) . |
| WO95/28466 | 10/1995 | (WO) . |
| WO95/28467 | 10/1995 | (WO) . |
| WO95/28468 | 10/1995 | (WO) . |
| WO95/28469 | 10/1995 | (WO) . |
| WO95/28473 | 10/1995 | (WO) . |

* cited by examiner

PH-CONTROLLED RELEASE OF DETERGENT COMPONENTS

This application is filed under 35 U.S.C. 371 and based on PCT/EP98/00474, filed Jan. 29, 1998.

BACKGROUND OF THE INVENTION

1. Field of the Invention

This invention relates to coated solid detergent components and to detergent compositions containing these coated components. More particularly, the invention relates to detergent compositions which release one or more of their ingredients to the wash liquor with delay and under control, the release of these ingredients being controlled through the pH value of the wash liquor.

The controlled release of individual detergent components at certain stages of the washing process is both economically and ecologically advantageous and, accordingly, is the subject of intensive research. Whereas, in principle, each individual detergent component can be released at a certain time through suitable physical and/or chemical measures, this controlled release is of paramount importance above all with regard to the interplay between bleaching and enzymatic cleaning. Accordingly, most publications are concerned with solving the problem of separating bleaching and enzymatic cleaning from one another as a function of time because the aggressive bleaching agents deactivate or even destroy enzymes. In principle, there are two ways of achieving this, namely: delayed release of the bleaching agents so that enzymatic cleaning is over before the bleaching agents are released into the wash liquor and delayed release of the enzymes when the bleaching process is almost at an end. Since the bleaching agents destroy excess enzyme and thus prevent it from remaining on the laundry (odor formation), the first alternative is generally adopted. Another advantage of coating particles of bleaching agent lies in the increased stability in storage because uncoated bleaching agents are rapidly hydrolyzed in the event of prolonged storage, especially in moist air, with the result that the detergent compositions lose washing power.

Numerous ways and means are available for coating detergent ingredients. Various factors, such as the temperature or the hydrolysis of the coating material, may be utilized for the release process, depending on the particular solution adopted. Melt coating, in which the shell or coating only becomes permeable beyond a certain temperature, is difficult to achieve on account of the low washing temperatures preferred today because problems, such as lump formation, occur at low softening temperatures. Coating materials which hydrolyze under the effect of moisture also have disadvantages in regard to the stability in storage of the composition. Accordingly, there is a need to find a coating material which, on the one hand, would dissolve quickly without affecting the washing process providing certain conditions are maintained in the wash liquor and which, on the other hand, would be so stable that storage would not present any problems.

2. Discussion of Related Art

Detergent and bleaching compositions which contain a hydrogen peroxide source and a peroxy acid bleach precursor (bleach activator) and which produce an initial pH value in the alkaline range (pH 10–11) in the wash liquor and the delayed release of acid into the wash liquor to achieve a reduced pH value therein are described in the prior art literature, cf. for example European patent applications EPA-0 290 081 (Unilever) and EP-A-0 396 287 (Clorox).

The delayed release of individual components in bleach-containing detergent compositions is mentioned in a number of patents. International patent applications WO 95/28454 (Procter & Gamble) and the series from WO 95128464 to WO 951284469 (all Procter & Gamble) and WO 95128473 (Procter & Gamble) disclose bleach-containing compositions which contain a hydrogen peroxide precursor and a peroxy acid precursor, the release of the peroxy acid being controlled so that 50% of the peroxy acid concentration (so-called T50 Test) is reached within 180 to 480 seconds. The controlled release of the ingredients is achieved by coating individual ingredients, defined particle sizes, compacting and mechanical or manual addition. The particular ingredients coated vary from one application to another. Thus, in WO 95/28464, the release of the peracid is delayed in relation to the release of a complexing agent; in WO 95/28465 the release of the peracid is delayed in relation to the release of a builder and, in WO 95/28467, an enzyme is released before the peracid. WO 95/28466 describes the delayed release of an enzyme in relation to the release of a surfactant while WO 95/28468 and WO 95/28469 describe detergent compositions in which the release of an enzyme is delayed in relation to the release of a complexing agent for heavy metal ions or in relation to the release of a water-soluble builder. The systematic controlled release of individual components by controlling the pH value is not mentioned in any patent application of this series.

The coating of bleaching agents or bleach activators is also known from the prior art. U.S. Pat. No. 5,000,869 (Safe Aid Products) describes detergent compositions containing a coated halogenated glycol uril compound which is released through pH control. In this detergent composition, the bleaching agent is coated with a polymer which dissolves at a pH value above 6 and preferably at a pH value of 7.2 to 11.

WO 94/15010 (Procter & Gamble) discloses the coating of TAED with water-soluble acidic polymers, the coating being applied in the form of a melt, by spraying or in the form of solutions and dispersions, and also describes the simultaneous use of percarbonate which, in a preferred embodiment, is also coated. The acidic polymer has a solubility of at least 5 g/l at 20° C.

EP-A-0 651 053 (Procter & Gamble) describes detergent compositions which contain an alkali metal percarbonate coated with alkali metal sulfate and carbonate, a bleach activator and a (coated) acidifying agent to be released with delay, so that the pH value of the wash liquor (1% solution at 20° C.) is initially 9.5 to 13, falling to pH 7 to 9.3 after the acidifying agent has been completely released. The time required for complete release of the acidifying agent is between 30 seconds and 10 minutes. It is only when the pH value falls below a certain threshold that the coating of the bicarbonate is attacked and dissolved so that the bleaching effect is developed.

Coated bleaching agents which are only released into the wash liquor at an increasing pH value are not described in the prior art.

Now, the problem addressed by the present invention was to develop a system which would enable detergent ingredients, more especially bleaching agents, to be released through pH control and which would allow the release of those ingredients to take place in alkaline medium.

DESCRIPTION OF THE INVENTION

Accordingly, the present invention relates to a washing process for washing textiles using a solid particulate detergent composition, the pH value of the wash liquor being below 8 after the detergent has dissolved and rising to values above pH 8.5 through the dissolution of a coated alkalizing agent as the washing process progresses, the pH values above 8.5 enabling a specially coated ingredient to be released and allowing that ingredient to develop its effect with delay.

In one particular embodiment of the invention, a bleaching agent, preferably sodium percarbonate, is used as the alkalizing agent while a bleach activator, preferably tetraacetyl ethylenediamine (TAED), is used as the specially coated ingredient.

The present invention also relates to a solid particulate detergent composition containing a) 1 to 40% by weight of a coated bleaching agent, b) 0.5 to 15% by weight of a bleach activator, c) 0.1 to 40% by weight of an acidifying agent, characterized in that the bleaching agent is coated with a shell-forming material which dissolves slowly in water irrespective of the pH value, the bleach activator is coated with a polymeric acid and the acidifying agent is used without any coating.

Through the presence of the acidifying agent, the pH value in the wash liquor is comparatively low, i.e. below 8, when the detergent composition is added. Thereafter the coating of the bleaching agent dissolves slowly and increasingly releases alkaline bleaching agent so that the pH value of the wash liquor increases. When the pH value of the liquor exceeds a value of about 8.5, the coating of the bleach activator begins to dissolve and releases the bleach activator. The full bleaching effect then begins to develop in the wash liquor with a certain delay. The time required for the bleaching effect to begin may be determined on the one hand through the quantity of acidifying agent added and, on the other hand, through the thickness and permeability of the coatings on the bleaching agent and the bleach activator. Depending on the formulation and the washing conditions, time intervals of 1 to 20 minutes are possible, for example for enzymatic cleaning to take place without most of the bleaching agent being present. The detergent composition shows excellent stability in storage through the coating of both the bleaching agent and the bleach activator and does not lose any of its bleaching activity, even in moist air.

Sodium perborate tetrahydrate and sodium perborate monohydrate are particularly important as coated bleaching agents which yield $H_2O_2$ in water (component a). Other suitable bleaching agents are, for example, sodium percarbonate, peroxypyrophosphates, citrate perhydrates and $H_2O_2$-yielding peracidic salts or peracids, such as perbenzoates, peroxophthalates, diperazelaic acid, phthaloiminoperacid or diperdo-decanedioic acid. The content of coated bleaching agents in the detergent is from 1 to 40% by weight and more particularly from 10 to 20% by weight, perborate monohydrate or percarbonate advantageously being used.

Suitable shell-forming materials for coating the particles of bleaching agent are water-soluble materials which dissolve slowly in the wash liquor, i.e. do not lead to any sudden release of the coated bleaching agent, and of which the dissolving properties are not too pH-dependent. Other preferred coating materials are those which, on dissolving, do not affect the pH value of the wash liquor. Preferred coating materials are fatty alcohols which may optionally be used in admixture with other coating materials. A mixture of fatty alcohols and aluminium stearate is mentioned purely by way of example. Other coating materials which have already been used for coating particles of bleaching agent are summarized in the following: magnesium sulfate and sodium hexaphosphate (BE 857 017, Solvay Interox), dihydrogen phosphate or pyrophosphates (EP 024 201, Clorox), phosphonic acids (EP 295 384, Degussa), sodium metaborate and silicate (DE 28 10 379, Degussa), waterglass and sodium polyphosphate (DE 27 12 138, Degussa), sodium sulfate, sodium carbonate and silicate (DE 26 22 610, Solvay Interox) or sodium bicarbonate (DE 24 17 572, Solvay Interox), borax and magnesium sulfate (DE 33 21 082, Kao), boric acid (DE 28 00 916, Solvay Interox) and also partly organic components, such as fatty derivatives, paraffins and waxes (EP 030 759, Solvay Interox, melting temperature of the compounds between 25 and 90° C.), polyethylene glycols and fatty acid esters thereof with a molecular weight of 300 to 1,700 (DE 23 37 338, Solvay Interox), combinations with magnesium oxide (U.S. Pat. No. 4,131,879, Gretay AG and U.S. Pat. Nos. 4,120,812 and 4,131,462, both FMC Corp.), vinyl chloride/ethylene copolymer emulsions (DE 24 02 393, Solvay Interox) or vinyl chloride/ethylene/methacrylate copolymer emulsions (DE 24 02 392, Solvay Interox).

The coating materials may be applied from the melt or from solutions or dispersions, the solvent or emulsifier being removed by evaporation. They may also be applied as a fine powder, for example by electrostatic techniques, although this method does lead to uneven and poorly adhering coatings. The coating materials may be applied to the particles of bleaching agent in stirred mixer/granulators. However, they are preferably applied in a fluidized bed, in which case the particles may simultaneously be graded. Should the coating materials lead to tacky products under certain conditions, it may be advisable additionally to "powder" the coated particles of bleaching agent with fine-particle materials. Suitable powdering or dusting agents are any fine-particle materials, including other detergent ingredients, such as builders. Preferred additional powdering agents are zeolites, silicates, polymeric polycarboxylates, carbonate, citrates, starch, etc. The acidifying agent may also be partly used for powdering.

Suitable coated bleach activators (component b) are compounds which form aliphatic peroxocarboxylic acids preferably containing 1 to 10 carbon atoms and more preferably 2 to 4 carbon atoms and/or optionally substituted perbenzoic acid under perhydrolysis conditions. Substances which bear O- and/or N-acyl groups with the number of carbon atoms mentioned and/or optionally substituted benzoyl groups are suitable. Preferred bleach activators are polyacylated alkylenediamines, more especially tetraacetyl ethylenediamine (TAED), acylated triazine derivatives, more particularly 1,5-diacetyl-2,4-dioxohexahydro-1,3,5-triazine (DADHT), acylated glycol urils, more particularly tetraacetyl glycol uril (TAGU), N-acyl imides, more particularly N-nonanoyl succinimide (NOSI), acylated phenol sulfonates, more especially n-nonanoyl or isononanoyloxybenzenesulfonate (n- or iso-NOBS), carboxylic anhydrides, more especially phthalic anhydride, acylated polyhydric alcohols, more especially triacetin, ethylene glycol diacetate, 2,5diacetoxy-2,5dihydrofuran and acetylated sorbitol and mannitol and the mixtures thereof (SORMAN) described in European patent application EP 0 525 239 (Ausimont SPA), acylated sugar derivatives, more especially pentaacetyl glucose (PAG), pentaacetyl fructose, tetraacetyl xylose and octaacetyl lactose, and acetylated, optionally N-alkylated glucamine and gluconolactone and/or N-acylated lactams, for example N-benzoyl caprolactam, which are known from International patent applications WO 94127970, WO 94128102, WO 94128103, WO 95100626

(all Procter & Gamble), WO 95114759 (Warwick) and WO 95/17498 (Procter & Gamble). The acyl lactams described in International patent application WO 95114075 (Degussa) are also prefer- ably used. The combinations of conventional bleach activators known from German patent application DE 44 43 177 (Henkel) may also be used. Coated bleach activators such as these are present in quantifies of 0.5% by weight to 15% by weight, based on the detergent as a whole.

The coating of the bleach activator is carried out with polymeric acids which only dissolve at pH values above 8. At pH values below 8, the coated bleach activator particles can be stirred for hours in aqueous solution without dissolving. Polymeric acids particularly suitable for coating are, for example, polyacrylates which are distinguished on the one hand by the required pH-dependent solubility and, on the other hand, by favorable processing properties. Other polymeric acids which may be used as coating materials are copolymers of an unsaturated polycarboxylic acid, such as maleic acid, citraconic acid, itaconic acid and mesaconic acid, with an unsaturated monocarboxylic acid, such as acrylic acid or α-alkyl-substituted acrylic acids.

The bleach activators may be coated in basically the same way as the bleaching agents. A process in which the polymeric acids are applied to the bleach activators via a dispersion is preferred.

The coating materials both for the bleaching agent and for the bleach activator are used in quantities which ensure optimum coordination of the individual components and hence precise controlled release. The quantity of coating material used will be gauged according to the time interval in which no release is to take place and according to the size of the coated particles. Preferred embodiments use less than 20% by weight of coating material, based on the weight of the coated particles, quantities of less than 10% by weight of the coating materials being particularly preferred.

The acidifying agent used as the third component is used in quantities of 0.1 to 40% by weight and preferably in quantities of 1 to 25% by weight, based on the final detergent. Any water-soluble substances capable of reducing the pH value of an aqueous solution to below 8 may be used as the acidifying agent. In cooperation with the other components of the detergents according to the invention, it is possible in this way to reach a starting pH value which is slowly increased as the washing process progresses (release of the bleaching agent), ultimately leading to release of the bleach activator and hence to the onset of the bleaching effect at pH values in the wash liquor above 8.5.

Preferred acidifying agents are inorganic and organic acids, for example solid mono-, oligo- and polycarboxylic acids, such as citric acid, tartaric acid and succinic acid, polycarboxylic acids, such as polyacrylic acid, and also such acids as malonic acid, adipic acid, maleic acid, fumaric acid, oxalic acid, boric acid or amidosulfonic acid and mixtures of the acids mentioned. Acidic salts, such as hydrogen sulfates or carbonates, may also be used as acidifying agents, in which case the only important requirement again is to ensure that the pH conditions are maintained. In order to obtain a wash liquor with a pH value below 8 as quickly as possible after the detergent according to the invention has dissolved, the acidifying agents should be selected for their ability to dissolve quickly and to adjust the pH value rapidly to the required levels. Any coating which would delay the dissolving process is unsuitable for the acidifying agents used for the purposes of the present invention.

From the applicational point of view, the acidifying agent(s) are required to be non-volatile. From this standpoint, solid acidifying agents which combine a minimal tendency to sublimate and a high melting point with high solubility in water are clearly preferred. Liquid or paste-form acidifying agents can only be used in small quantities below 5% by weight, based on the composition as a whole, and, if used, should be made up in such a way as to guarantee stability in storage, even at high air humidity levels. For this reason, liquid and readily volatile acids and acids which cannot be handled in powder-form detergents, such as hydrochloric acid, nitric acid or sulfuric acid, are automatically ruled out. In selecting the acidifying agent(s), it is of course important to bear in mind that the resulting wash liquor should damage neither the washing nor human skin.

Besides the coated components and uncoated auxiliaries which provide for the pH-controlled release of the coated ingredients, the detergents according to the invention contain other typical detergent ingredients, more especially anionic and nonionic surfactants, builders and other auxiliaries, such as soil repellents, foam inhibitors, salts of polyphosphonic acids, optical brighteners, enzymes, enzyme stabilizers, small quantities of neutral filler salts and dyes and perfumes, opacifying or pearlescing agents.

Suitable anionic surfactants are, for example, those of the sulfonate and sulfate type. Suitable surfactants of the sulfonate type are preferably olefin sulfonates, i.e. mixtures of alkene and hydroxyalkane sulfonates, and the disulfonates obtained, for example, from $C_{12-18}$ monoolefins with an internal or terminal double bond by sulfonation with gaseous sulfur trioxide and subsequent alkaline or acidic hydrolysis of the sulfonation products. Other suitable surfactants of the sulfonate type are the alkane sulfonates obtained from $C_{12-18}$ alkanes, for example by sulfochlorination or sulfoxidation and subsequent hydrolysis or neutralization. The esters of α-sulfofatty acids (ester sulfonates), for example the α-sulfonated methyl esters of hydrogenated coconut oil, palm kernel oil or tallow fatty acids, are also suitable.

Other suitable anionic surfactants are sulfonated fatty acid glycerol esters. Fatty acid glycerol esters in the context of the present invention are the monoesters, diesters and triesters and mixtures thereof which are obtained where production is carried out by esterification of a monoglycerol with 1 to 3 moles of fatty acid or in the transesterification of triglycerides with 0.3 to 2 moles of glycerol. Preferred sulfonated fatty acid glycerol esters are the sulfonation products of saturated fatty acids containing 6 to 22 carbon atoms, for example caproic acid, caprylic acid, capric acid, myristic acid, lauric acid, palmitic add, stearic acid or behenic acid.

Suitable surfactants of the sulfate type are the sulfuric acid mono-esters of primary alcohols of natural and synthetic origin. Preferred alk(en)yl sulfates are the alkali metal salts and, in particular, the sodium salts of the sulfuric acid semiesters of $C_{12-18}$ fatty alcohols, for example cocofatty alcohol, tallow fatty alcohol, lauryl, myristyl, cetyl or stearyl alcohol, or $C_{10-20}$ oxoalcohols and the corresponding semiesters of secondary alcohols with the same chain length. Other preferred alk(en)yl sulfates are those with the chain length mentioned which contain a synthetic, linear alkyl chain based on a petrochemical and which are similar in their degradation behavior to the corresponding compounds based on oleochemical raw materials. $C_{16-18}$ alk(en)yl sulfates are particularly preferred from the point of view of washing technology. It can also be of particular advantage, especially for machine detergents, to use $C_{16-18}$ alk(en)yl sulfates in combination with relatively low-melting anionic surfactants and, in particular, with anionic surfactants which have a lower Krafft point and which have a lower tendency to crystallize at relatively low washing temperatures, for example from room temperature to 40° C. In one preferred embodiment of the invention, therefore, the detergents contain mixtures of short-chain and long-chain fatty alkyl sulfates, preferably $C_{12-18}$ fatty alkyl sulfates or mixtures of $C_{12-14}$ fatty alkyl sulfates or $C_{12-18}$ fatty alkyl sulfates with $C_{16-18}$ fatty alkyl sulfates and, more particularly, $C_{12-16}$ fatty alkyl sulfates with $C_{16-18}$ fatty alkyl sulfates. However, another preferred embodiment of the invention is characterized by the use not only of saturated alkyl sulfates, but also of unsaturated alkenyl sulfates with an alkenyl chain length of preferably $C_{16}$ to $C_{22}$. In this embodiment, mixtures of saturated sulfonated fatty alcohols consisting predominantly of $C_{16}$ and unsaturated, sulfonated fatty alcohols consisting predominantly of $C_{18}$, for example those derived from solid or liquid fatty alcohol mixtures of the HD-Ocenol® type (a product of Henkel KGaA), are particularly preferred. Ratios by weight of alkyl sulfates to alkenyl sulfates of 10:1 to 1:2 are preferred, ratios by weight of about 5:1 to 1:1 being particularly preferred. Other suitable anionic surfactants are 2,3-alkyl sulfates which may be produced, for example, by addition of sulfuric acid onto α-olefins.

The sulfuric acid monoesters of linear or branched $C_{7-21}$ alcohols ethoxylated with 1 to 6 moles of ethylene oxide, such as 2-methyl-branched $C_{9-11}$ alcohols containing on average 3.5 moles of ethylene oxide (EO) or $C_{12-18}$ fatty alcohols containing 1 to 4 EO, are also suitable. In view of their high foaming capacity, they are only used in relatively small quantities, for example in quantities of 1 to 5% by weight, in detergents.

Other suitable anionic surfactants are the salts of alkyl sulfosuccinic acid which are also known as sulfosuccinates or as sulfosuccinic acid esters and which represent the monoesters and/or diesters of sulfosuccinic acid with alcohols, preferably fatty alcohols and, more particularly, ethoxylated fatty alcohols. Preferred sulfosuccinates contain $C_{8-18}$ fatty alcohol radicals or mixtures thereof. Particularly preferred sulfosuccinates contain a fatty alcohol radical derived from ethoxylated fatty alcohols which, regarded in isolation, represent nonionic surfactants (for a description, see below). Of these, sulfosuccinates of which the fatty alcohol radicals are derived from ethoxylated fatty alcohols with a narrow homolog distribution are particularly preferred. Alk(en)yl succinic acid preferably containing 8 to 18 carbon atoms in the alk(en)yl chain or salts thereof may also be used.

Other suitable anionic surfactants are, in particular, soaps. Suitable soaps are saturated fatty acid soaps, such as the salts of lauric acid, myristic acid, palmitic acid, stearic acid, hydrogenated erucic acid and behenic acid, and soap mixtures derived in particular from natural fatty acids, for example coconut oil, palm kernel oil or tallow fatty acids. Particularly preferred soap mixtures are those of which 50 to 100% by weight consists of saturated $C_{12-24}$ fatty acid soaps and 0 to 50% by weight of oleic acid soap.

The anionic surfactants, including the soaps, may be present in the form of their sodium, potassium or ammonium salts and as soluble salts of organic bases, such as mono-, di- or triethanolamine. The anionic surfactants are preferably present in the form of their sodium or potassium salts and, more preferably, in the form of their sodium salts.

Besides anionic surfactants, nonionic, cationic, zwitterionic or amphoteric surfactants may also be used in the detergent compositions. Nonionic surfactants are particularly preferred.

Preferred nonionic surfactants are alkoxylated, advantageously ethoxylated, more particularly primary alcohols preferably containing 8 to 18 carbon atoms and an average of 1 to 12 moles of ethylene oxide (EO) per mole of alcohol, in which the alcohol radical may be linear or, preferably, 2-methyl-branched or may contain linear and methyl-branched radicals in the form of the mixtures typically present in oxoalcohol radicals. However, alcohol ethoxylates containing linear radicals of alcohols of native origin with 12 to 18 carbon atoms, for example coconut oil fatty alcohol, palm oil fatty alcohol, tallow fatty alcohol or oleyl alcohol, and an average of 2 to 8 EO per mole of alcohol are particularly preferred. Preferred ethoxylated alcohols include, for example, $C_{12-14}$ alcohols containing 3 EO or 4 EO, $C_{9-11}$ alcohol containing 7 EO, $C_{12-18}$ alcohols containing 3 EO, 5 EO, 7 EO or 8 EO, $C_{12-18}$ alcohols containing 3 EO, 5 EO or 7 EO and mixtures thereof, such as mixtures of $C_{12-14}$ alcohol containing 3 EO and $C_{12-18}$ alcohol containing 5 EO. The degrees of ethoxylation mentioned are statistical mean values which, for a special product, may be either a whole number or a broken number. Preferred alcohol ethoxylates have a narrow homolog distribution (narrow range ethoxylates, NRE). In addition to these nonionic surfactants, fatty alcohols containing more than 12 EO may also be used. Examples of such fatty alcohols are tallow fatty alcohol containing 14 EO, 25 EO, 30 EO or 40 EO.

In addition, alkyl glycosides corresponding to the general formula $RO(G)_x$ may be used as further nonionic surfactants. In this general formula, R is a primary, linear or methyl-branched, more particularly 2-methyl-branched, aliphatic radical containing 8 to 22 and preferably 12 to 18 carbon atoms and G is a glycose unit containing 5 or 6 carbon atoms, preferably glucose. The degree of oligomerization x, which indicates the distribution of monoglycosides and oligoglycosides, is a number of 1 to 10 and preferably a number of 1.2 to 1.4.

Another class of preferred nonionic surfactants which are used either as sole nonionic surfactant or in combination with other nonionic surfactants are alkoxylated, preferably ethoxylated or ethoxylated and propoxylated, fatty acid alkyl esters preferably containing 1 to 4 carbon atoms in the alkyl chain, more particularly the fatty acid methyl esters which are described, for example, in Japanese patent application JP 58/217598 or which are preferably produced by the process described in International patent application WO-A90/13533 (Henkel).

Nonionic surfactants of the amine oxide type, for example N-cocoalkyl-N,N-dimethylamine oxide and N-tallowalkyl-N,N-dihydroxyethyl amine oxide, and the fatty acid alkanolamide type are also suitable. The quantity in which these nonionic surfactants are used is preferably no more, in particular no more than half, the quantity of ethoxylated fatty alcohols used.

Other suitable surfactants are polyhydroxyfatty acid amides corresponding to formula (I):

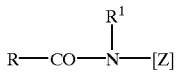

(I)

in which RCO is an aliphatic acyl radical containing 6 to 22 carbon atoms, $R^1$ is hydrogen, an alkyl or hydroxyalkyl radical containing 1 to 4 carbon atoms and [Z] is a linear or branched polyhydroxyalkyl radical containing 3 to 10 carbon atoms and 3 to 10 hydroxyl groups. The polyhydroxyfatty acid amides are known substances which normally may be obtained by reductive amination of a reducing sugar with ammonia, an alkylamine or an alkanolamine and subsequent acylation with a fatty acid, a fatty acid alkyl ester or a fatty acid chloride.

The group of polyhydroxyfatty acid amides also includes compounds corresponding to formula (II):

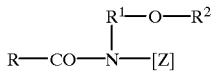

(II)

in which R is a linear or branched alkyl or alkenyl group containing 7 to 12 carbon atoms, $R^1$ is a linear, branched or cyclic alkyl group or an aryl group containing 2 to 8 carbon atoms and $R^2$ is a linear, branched or cyclic alkyl group or an aryl group or a hydroxyalkyl group containing 1 to 8 carbon atoms, $C_{1-4}$ alkyl or phenyl groups being preferred, and [Z] is a linear polyhydroxyalkyl group, of which the alkyl chain is substituted by at least two hydroxyl groups, or alkoxylated, preferably ethoxylated or propoxylated, derivatives of such a group.

[Z] is preferably obtained by reductive amination of a reduced sugar, for example glucose, fructose, maltose, lactose, galactose, mannose or xylose. The N-alkoxy or N-aryloxy-substituted compounds may then be converted into the required polyhydroxyfatty acid amides by reaction with fatty acid methyl esters in the presence of an alkoxide as catalyst, for example in accordance with the teaching of International patent application WO-A-95/07331 (Procter & Gamble).

Besides the surfactant components, the detergent granules may also contain builders and other ingredients of detergents.

In addition to silicates, other builders and cobuilders may also be used as builders in the detergent compositions. These include, above all, zeolites, citrates and polymeric polycarboxylates.

Suitable crystalline layer-form sodium silicates correspond to the general formula $Na_2MSi_xO_{2x+1}.yH_2O$, where M is sodium or hydrogen, x is a number of 1.9 to 4 and y is a number of 0 to 20, preferred values for x being 2, 3 or 4. Crystalline layer silicates such as these are described, for example, in European patent application EP-A-0 164 514. Preferred crystalline layer silicates corresponding to the above formula are those in which M is sodium and x has a value of 2 or 3. Preferred crystalline layer silicates corresponding to the above formula are those in which M is sodium and x assumes the value 2 or 3. Both β- and δ-sodium disilicates $Na_2Si_2O_5.yH_2O$ are particularly preferred, β-sodium disilicate being obtainable, for example, by the process described in International patent application WO-A-91108171 (Henkel).

Other suitable builders are amorphous sodium silicates with a modulus ($Na_2O:SiO_2$ ratio) of 1:2 to 1:3.3, preferably 1:2 to 1:2.8 and more preferably 1:2 to 1:2.6 which dissolve with delay and exhibit multiple wash cycle properties. The delay in dissolution in relation to conventional amorphous sodium silicates can have been obtained in various ways, for example by surface treatment, compounding, compacting or by overdrying. In the context of the invention, the term "amorphous" is also understood to encompass "X-ray amorphous". In other words, the silicates do not produce any of the sharp X-ray reflexes typical of crystalline substances in X-ray diffraction experiments, but at best one or more maxima of the scattered X-radiation which have a width of several degrees of the diffraction angle. Particularly good builder properties may even be achieved where the silicate particles produce crooked or even sharp diffraction maxima in electron diffraction experiments. This may be interpreted to mean that the products have microcrystalline regions between 10 and a few hundred nm in size, values of up to at most 50 nm and, more particularly, up to at most 20 nm being preferred. So-called X-ray amorphous silicates such as these, which also dissolve with delay in relation to conventional waterglasses, are described in German patent application DE-A44 00 024 (Henkel) Compacted amorphous silicates, compounded amorphous silicates and overdried X-ray-amorphous silicates are particularly preferred.

The finely crystalline, synthetic zeolite containing bound water used in accordance with the invention is preferably zeolite A and/or P. Zeolite MAP® (a commercial product of Crosfield) is particularly preferred as the zeolite P. However, zeolite X and mixtures of A, X and/or P are also suitable. The zeolite may be used in the form of a spray-dried powder or even as an undried stabilized suspension still moist from its production. Where the zeolite is used in the form of a suspension, the suspension may contain small additions of nonionic surfactants as stabilizers, for example 1 to 3% by weight, based on zeolite, of ethoxylated $C_{12-18}$ fatty alcohols containing 2 to 5 ethylene oxide groups, $C_{12-14}$ fatty alcohols containing 4 to 5 ethylene oxide groups or ethoxylated isotridecanols. Suitable zeolites have an average particle size of less than 10 μm (volume distribution as measured by the Coulter Counter Method) and contain preferably 18 to 22% by weight and, more preferably, 20 to 22% by weight of bound water.

The generally known phosphates may of course also be used as builders providing this is not ecologically problematical. Suitable phosphate builders are, in particular, the sodium salts of the orthophosphates, pyrophosphates and, in particular, the tripolyphosphates. Their content is generally not more than 25% by weight and preferably not more than 20% by weight, based on the final detergent. In some cases, it has been found that tripolyphosphates in particular lead to a synergistic improvement in multiple wash cycle performance in combination with other builders, even in small quantities of up to at most 10% by weight, based on the final detergent.

Other suitable organic builders are dextrins, for example oligomers and polymers of carbohydrates which may be obtained by partial hydrolysis of starches. The hydrolysis may be carried out by standard methods, for example acid- or enzyme-catalyzed methods. The end products are preferably hydrolysis products with average molecular weights of 400 to 500,000. A polysaccharide with a dextrose equivalent (DE) of 0.5 to 40 and, more particularly, 2 to 30 is preferred, the DE being an accepted measure of the reducing effect of a polysaccharide by comparison with dextrose which has a DE of 100. Both maltodextrins with a DE of 3 to 20 and dry glucose sirups with a DE of 20 to 37 and also so-called yellow dextrins and white dextrins with relatively high molecular weights of 2,000 to 30,000 may be used. A preferred dextrin is described in British patent application 94 19 091 (Cerestar). The oxidized derivatives of such dextrins are their reaction products with oxidizing agents which are capable of oxidizing at least one alcohol function of the saccharide ring to the carboxylic acid function. Dextrins thus oxidized and processes for their production are known, for example, from European patent applications EP-A-0 232 202 (Roquette Freres), EP-A-0 427 349 (Naturwissenschaftliches Institut NL), EP-A-0 472 042 (Fertec Ferruzzi) and EP-A-0 542 496 (Procter and Gamble) and from International patent applications WO-A-92/18542 (Novamont), WO-A-93108251 (Henkel), WO-A-94/28030 (Henkel), WO-A-95/07303 (Naturwissen-schaftliches Institut NL), WO-A-95/12619 (Agrartechnisches Institut NL)and WO-A-95/20608 (Henkel). A product oxidized at $C_6$ of the saccharide ring can be particularly advantageous.

Other suitable co-builders are oxydisuccinates and other derivatives of disuccinates, preferably ethylenediamine disuccinate. The glycerol disuccinates and glycerol trisuccinates described, for example, in U.S. Pat. Nos. 4,524,009 and 4,639,325 (both Staley), in European patent application EP-A-0 150 930 (Staley) and in Japanese patent application JP 93/339896 are also particularly preferred in this regard. Suitable quantities for zeolite-containing and/or silicate-containing formulations are between 3 and 15% by weight.

Other useful organic co-builders are, for example, acetylated hydroxycarboxylic acids and salts thereof which may even be present in lactone form and which contain at least 4 carbon atoms, at least one hydroxy group and at most two acid groups. Co-builders such as these are described, for example, in International patent application WO-A-95/20029 (Henkel).

Besides the surfactants, bleaching agents and builders, many other compounds may be used in detergents, including for example foam inhibitors, phosphonates, enzymes and optical brighteners.

It can be of advantage to add typical foam inhibitors to the detergents where they are used for machine washing. Suitable foam inhibitors are, for example, soaps of natural or synthetic origin with a high percentage content of $C_{18\ 24}$ fatty acids. Suitable non-surface-active foam inhibitors are, for example, organopolysiloxanes and mixtures thereof with microfine, optionally silanized silica and also paraffins, waxes, microcrystalline waxes and mixtures thereof with silanized silica or bis-stearyl ethylenediamide. Mixtures of various foam inhibitors, for example mixtures of silicones, paraffins or waxes, are also used with advantage. The foam inhibitors, more particularly silicone- or paraffin-containing foam inhibitors, are preferably fixed to a granular water-soluble or water-dispersible support. Mixtures of paraffins and bis-stearyl ethylenediamides are particularly preferred.

The neutrally reacting sodium salts of, for example, 1-hydroxyethane-1,1-diphosphonate, diethylenetriamine pentamethylene phosphonate or ethylenediamine tetramethylene phosphonate are preferably used in quantities of 0.1 to 1.5% by weight as the salt of polyphosphonic acids.

Suitable enzymes are those from the class of proteases, lipases, amylases, cellulases and mixtures thereof. Enzymes obtained from bacterial strains or fungi, such as *Bacillus subtilis, Bacillus licheniformis* and *Streptomyces griseus* are particularly suitable. Proteases of the subtilisin type are preferably used, proteases obtained from *Bacillus lentus* being particularly suitable. Enzyme mixtures, for example mixtures of protease and amylase or protease and lipase or protease and cellulase or mixtures of cellulase and lipase or mixtures of protease, amylase and lipase or protease, lipase and cellulase, but especially cellulase-containing mixtures, are of particular interest. (Per)oxidases have also proved to be suitable in some cases. The enzymes may be adsorbed to supports and/or encapsulated in shell-forming substances to protect them against premature decomposition. The percentage content of enzymes, enzyme mixtures or enzyme granules may be, for example, of the order of 0.1 to 5% by weight and preferably from 0.1 to around 2% by weight.

The detergents according to the invention may contain derivatives of diaminostilbene disulfonic acid or alkali metal salts thereof as optical brighteners. Suitable optical brighteners are, for example, salts, of 4,4'-bis-(2-anilino-4-morpholino-1,3,5-triazinyl-6-amino)-stilbene-2,2'-disulfonic acid or compounds of similar composition which contain a diethanolamino group, a methylamino group, an anilino group or a 2-methoxyethylamino group instead of the morpholino group. Brighteners of the substituted diphenyl styryl type, for example alkali metal salts of 4,4'-bis-(2-sulfostyryl)-diphenyl, 4,4'-bis-(4-chloro-3-sulfostyryl) diphenyl or 4-(4-chlorostyryl)4'-(2-sulfostyryl)diphenyl, may also be present. Mixtures of the brighteners mentioned above may also be used.

The invention described in the foregoing is not confined to the coating of bleaching agents and bleach activators. On the contrary, any detergent ingredient may be coated in accordance with the invention and thus released through pH control. The parameters to be observed in this regard are generally the coating of the ingredient to be released through pH control with polymeric acids, the coating of an alkalizing agent with a material that dissolves slowly in water irrespective of the pH value of the wash liquor and the use of an uncoated acidifying agent which provides for a low starting pH value in the wash liquor. Because the water-soluble coating dissolves slowly, the wash liquor becomes increasingly more alkaline with the release of the alkalizing agent until, finally, the coating of the polymeric acid begins to dissolve at pH values above 8.5 and releases the ingredient to be released through pH control to the wash liquor. In other possible variants for example, acidic bleaching may be followed by the release of an agent which destroys the bleaching agent. A further delay can be achieved through the particular thickness of the coating so that the timing of the release process can be effectively determined.

EXAMPLES

Coating of the Bleach Activator

Crystalline tetraacetyl ethylenediamine (TAED) was mixed with a 32% polyacrylate dispersion in a ratio of 5:1, granulated and dried at 45° C. The granules obtained in this way show high stability and can be stirred for several hours without dissolving in a pH-neutral to mildly acidic surfactant solution. In alkaline solution (pH >8.5), the granules disintegrate in 1 to 2 minutes.

Coating of the Bleaching Agent

Commercial sodium percarbonate was coated with 15% by weight of its weight of a mixture of fatty alcohols and aluminium stearate (2:1). The coating material was applied in the form of a melt which did not penetrate deeply into the particles and thus formed a relatively homogeneous coating layer, so that the particles dissolve in a narrow time interval. In order to obtain free-flowing granules, the coated particles of bleaching agent were additionally powdered with rice starch.

Production of the Detergent

A bleach-free and enzyme-free detergent composition of surfactants, builders and auxiliaries (for composition, see Table 1) was blended with the coated particles of bleaching agent, the coated particles of bleach activator and crystalline citric acid in the quantities shown in Table 2.

TABLE 1

| Ingredients of the detergent composition (% by weight) | |
|---|---|
| Soap | 5.42 |
| Sodium $C_{12-14}$ alkyl benzenesulfonate | 22.67 |
| Sodium $C_{14-16}$ fatty alcohol sulfate | 4.59 |
| $C_{12-18}$ fatty alcohol - 5E0 | 0.81 |
| Sodium carbonate | 4.55 |
| Zeolite A | 29.86 |
| Sodium silicate | 8.00 |
| Acrylic acid/maleic acid copolymer | 16.16 |
| Opt. brightener | 0.45 |

TABLE 1-continued

| Ingredients of the detergent composition (% by weight) | |
|---|---|
| Phosphonate | 2.30 |
| NaOH, 50% | 0.63 |
| Water | 3.88 |

TABLE 2

| Ingredients of the detergent composition according to the invention (% by weight) | |
|---|---|
| Detergent composition | 59.5% by weight |
| Coated bleaching agent (Na percarbonate) | 23.3% by weight |
| Coated bleach activator (TAED) | 7% by weight |
| Citric acid monohydrate | 10.2% by weight |

The detergent obtained in this way was dissolved in water (30° C., 16° d, dosage: 6 g/l) and the release of the TAED as peracetic acid was iodometrically determined. Immediately after the detergent had dissolved, the pH value fell to around 6.5 and then increased in 4 minutes to values above 8.5 (pH=9.2, constant after 5 mins.). The release of the peracetic acid only began after 4 minutes, i.e. at pH values of the wash liquor above 8.5.

What is claimed is:

1. A solid particulate detergent composition comprising:

a) 1 to 40 percent by weight of a coated bleaching agent, wherein said bleaching agent is coated with a composition which dissolves in water irrespective of the pH value;

b) 0.5 to 15 percent by weight of a bleach activator coated with a polymeric acid which only dissolves at pH values above 8; and c) 0.1 to 40 percent by weight of an acidifying agent.

2. The detergent composition of claim 1 wherein the coating composition of the bleaching agent comprises a fatty alchohol.

3. The detergent composition of claim 1 wherein the bleaching agent comprises sodium percarbonate, sodium perborate monohydrate or sodium perborate tetrahydrate.

4. The detergent composition of claim 1 wherein the bleach activator is selected from the group consisting of polyacylated alkylenediamines, acylated triazine derivatives, acylated glycol urils, N-acyl imides, acylated phenol sulfonates, carboxylic anhydrides, acylated polyhydric alcohols, acylated sugar derivatives, acetylated glucamine, gluconolactone and N-acylated lactams.

5. The detergent composition of claim 1 wherein the acidifying agent comprises a polycarboxylic acid.

6. The detergent composition of claim 1 comprising 10 to 20 percent by weight of said coated bleaching agent.

7. The detergent composition of claim 1 comprising 1 to 25 percent by weight of said acidifying agent.

8. The detergent composition of claim 1 wherein the polymeric acid coating comprises a polyacrylate or copolymers of an unsaturated polycarboxylic acid with an unsaturated monocarboxylic acid.

9. The detergent composition of claim 1 wherein the polymeric acid-coated bleach activator comprises less than 20 percent by weight of the polymeric acid coating.

10. The detergent composition of claim 1 wherein the polymeric acid-coated bleach activator comprises less than 10 percent by weight of the polymeric acid coating.

11. The detergent composition of claim 1, wherein the coating composition on the bleaching agent dissolves in an aqueous medium at a rate such that the bleaching agent is not exposed to the aqueous medium until 1 to 20 minutes after the coated bleaching composition is exposed to the aqueous medium.

12. The detergent composition of claim 1, wherein said bleach activator is tetraacetyl ethylenediamine (TAED).

13. The detergent composition of claim 1, wherein said bleach activator is ethylene glycol diacetate, 2,5-diacetoxy-2,5-dihydrofuran, acetylated sorbitol, acetylated mannitol or mixtures thereof.

* * * * *

UNITED STATES PATENT AND TRADEMARK OFFICE

CERTIFICATE OF CORRECTION

PATENT NO. : 6,225,276 B1
DATED : May 1, 2001
INVENTOR(S) : Thomas Gassenmeier, Juergen Millhoff, Thomas Mueller-Kirschbaum.

It is certified that error appears in the above-identified patent and that said Letters Patent is hereby corrected as shown below:

Title page,
References Cited, FOREIGN PATENT DOCUMENTS,
"0 164 154 12/1985 (EP)" should be -- 0 164 514 12/1985 (EP) --.

Signed and Sealed this

Thirteenth Day of November, 2001

*Attest:*

Nicholas P. Godici

NICHOLAS P. GODICI
*Acting Director of the United States Patent and Trademark Office*

*Attesting Officer*